United States Patent [19]

Ontko

[11] Patent Number: 5,002,277

[45] Date of Patent: Mar. 26, 1991

[54] FINGER INSERT FOR A BOWLING BALL

[75] Inventor: Phillip G. Ontko, Racine, Wis.

[73] Assignee: Bob's Business, Inc., Red Wing, Minn.

[21] Appl. No.: 586,195

[22] Filed: Sep. 21, 1990

[51] Int. Cl.[5] ..... A63B 37/00

[52] U.S. Cl. ..... 273/63 A; 273/54 R

[58] Field of Search ..... 273/63 R, 63 A, 63 B, 273/63 C, 63 D, 63 E, 63 F, 63 G

[56] References Cited

U.S. PATENT DOCUMENTS

| | | | |
|---|---|---|---|
| 3,342,488 | 9/1967 | Novatnak | 273/63 A |
| 3,454,440 | 7/1969 | Vezirakis | 273/63 A |
| 3,784,198 | 1/1974 | Bach | 273/63 A |
| 4,289,312 | 9/1981 | Heimbigner | 273/63 A |
| 4,416,452 | 11/1983 | Heimbigner | 273/63 A |
| 4,585,230 | 4/1986 | Martin | 273/63 A |
| 4,773,645 | 9/1988 | Todd et al. | 273/63 A |

*Primary Examiner*—George J. Marlo

*Attorney, Agent, or Firm*—Jansson, Ltd.

[57] ABSTRACT

An improved bowling ball insert includes a generally cylindrical body and an interior cavity formed therein. The shape of such cavity is partially defined by a generally planar first surface, by a curved surface and by a generally planar second surface. The shape thereby imparted to the cavity generally resembles that of the distal portion of a human finger. To provide a tactile indication of correct insertion depth of a finger within the insert, the second surface includes at least one projection extending outwardly from the second surface. In a highly preferred finger insert, the width of the first surface is selected to generally correspond to that of bowler's tape which may be applied to adhere to the first surface. The relative positions of the first, second and curved surfaces are such that when a strip of bowler's tape is applied to the first surface, a finger inserted into the cavity is urged toward the second surface and the curved surface by such tape.

9 Claims, 2 Drawing Sheets

FINGER INSERT FOR A BOWLING BALL

FIELD OF THE INVENTION

This invention is related generally to finger inserts for bowling balls and, more particularly, to a finger insert which has provisions for tactile positioning of the finger and for size adjustment using bowler's tape.

BACKGROUND OF THE INVENTION

Finger inserts are widely known and used to provide better control of a bowling ball. Such inserts typically have a body which is generally cylindrical in exterior shape to fit a hole formed in the ball. The interior cavity of the insert is configured to provide a particular advantage.

One example of such an insert is shown in Martin U.S. Pat. No. 4,585,230 (issued Apr. 29, 1986). The Martin insert has a cavity which is generally cylindrical in shape and includes a pair of adjoining planar surface portions arranged in edgewise angular relationship to one another. This V-shaped portion, contacted by the underside of a bowler's finger, is said to permit better control of the bowling ball by increasing the frictional engagement between the finger and the ball.

Another example of a finger insert is shown in Todd et al. U.S. Pat. No. 4,773,645 (issued Sept. 27, 1988). The Todd et al. insert likewise has a generally cylindrical interior cavity with a plurality of chord-like, sharp-edged ribs along one side thereof. The ribs are said to provide good frictional engagement between the finger and the insert.

Yet other examples of finger inserts are shown in Bach U.S. Pat. No. 3,784,198 (issued Jan. 8, 1974); Heimbigner U.S. Pat. No. 4,289,312 (issued Sept. 15, 1981) and Heimbigner U.S. Pat. No. 4,416,452 (issued Nov. 22, 1983). Still other known types of finger inserts are shown in the drawing and briefly described in the initial portion of the specification set out below.

While known inserts of the type described herein have been generally satisfactory, they tend to share certain disadvantages. In particular, they fail to appreciate the manner in which a finger insert may be constructed to provide a tactile indication of correct finger positioning within the insert. Another disadvantage is that such known inserts are devoid of any provision for using bowler's tape to adjust, within a range, the size of the cavity to fit fingers of different sizes. An improved finger insert which includes such features would be an important advance in the art.

OBJECTS OF THE INVENTION

It is an object of this invention to overcome some of the problems and shortcomings of the prior art.

Another object of this invention is to provide an improved finger insert having means for providing a tactile indication of correct depth of insertion of a finger within such insert.

Another object of this invention is to provide an improved finger insert wherein bowler's tape may be used to adjust the size of the interior cavity for different finger sizes.

Yet another object of this invention is to provide an improved finger insert having an interior cavity with a shape generally like that of a bowler's finger.

These and other important objects will be apparent from the descriptions of this invention which follow.

SUMMARY OF THE INVENTION

The improved finger insert has an interior cavity shaped generally like that of a human finger. Such insert has a tactile feature which permits the user to position a finger at the same location within the insert for each use of the bowling ball. Further, the insert has provisions for using bowler's tape to "customize" the size of the interior cavity to better fit the user's particular finger size.

In general, an improved bowling ball insert includes a generally cylindrical body and an interior cavity formed therein. The shape of such cavity is partially defined by a generally planar first surface extending along its length. Such shape is further defined by a curved surface and by a generally planar second surface which is spaced from the first surface and extends partially along the length of the cavity. The shape thereby imparted to the cavity generally resembles that of the distal portion of a human finger.

The body has a proximal end and a distal end and in a highly preferred embodiment, the cavity is generally wedge-shaped in cross section at that portion of the body adjacent the distal end. Such shape results from the relative positions of the first surface and the second surface. To provide a tactile indication of correct insertion depth of a finger within the insert, the second surface includes at least one projection (and preferably several projections embodied as ridges) extending outwardly from the second surface.

Bowling ball finger inserts, including those of the invention, are made to have interior cavities in several standard sizes. Since actual finger sizes are much more disparate, many users of known finger inserts have fingers which are misfitted to an insert to a greater or lesser extent. Accordingly, in a highly preferred finger insert, the width of the first surface and the width of commonly-available bowler's tape (which may be applied to adhere to the first surface) generally correspond to one another. The first surface is positioned generally at the top side of the cavity and the curved surface and the second surface are positioned generally at the bottom side of such cavity. The resulting relative positions of those surfaces are such that when a strip of bowler's tape is applied to the first surface, a finger inserted into the cavity is urged toward the second surface and the curved surface by such tape. This arrangement permits the insert to be easily adapted to fingers of differing sizes.

In a highly preferred embodiment, the cavity may be said to have certain geometric features which impart the desired finger-like shape. Specifically, the cavity has a longitudinal centerline and the curved surface has a generally uniform radius of curvature. An end of such radius is coincident with such longitudinal centerline. Further, the first surface has a longitudinal centerline which is generally parallel to and spaced from that of the cavity. The second surface has a longitudinal centerline which projects to intersect the projected centerline of the cavity and the projected centerline of the first surface. The distal end of the body is substantially enclosed and the intersection of the first surface, the second surface and the curved surface with such distal end defines an elongate aperture in such distal end.

DETAILED DESCRIPTION OF PREFERRED EMBODIMENTS

Figure 1:
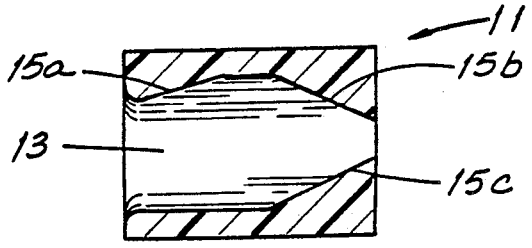
PRIOR ART FIG. 1
FIG. 1 is a cross sectional side elevation view of one type of known finger insert.

Before describing the preferred embodiments of the inventive insert 10, reference is made to FIG. 1 which shows a finger insert 11 of a known type. Such insert 11 has a generally cylindrical interior cavity 13 with a pair of planar ramps 15*a*, 15*b* positioned at the top thereof, one at either end. A third generally planar ramp 15*c* is located at one end thereof and is positioned opposite the ramp 15*b*. The insert is understood to angularly "pitch" the finger somewhat for assertedly better control.

Figure 2:
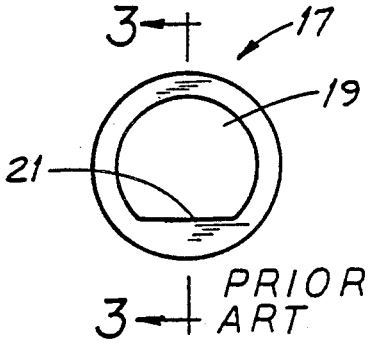
PRIOR ART FIG. 2
FIG. 2 is an end elevation view of another type of known finger insert.
Figure 3:
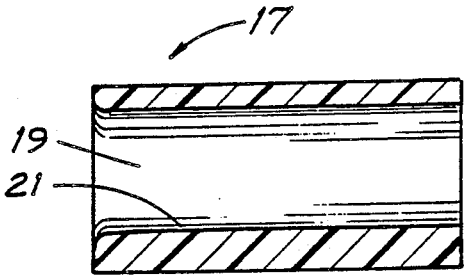
PRIOR ART FIG. 3
FIG. 3 is a cross sectional side elevation view of the insert of FIG. 2 taken along the viewing plane 3—3 thereof.

The insert 17 of FIGS. 2 and 3 also has a generally cylindrical cavity 19 with a single generally planar surface 21 running along its length. In the end view of FIG. 2, such surface 21 is positioned chord-like across a portion of the cavity 19 so that the end view of the cavity 19 as shown in FIG. 2 is generally D-shaped. The bottom surface of the finger is placed to contact this planar surface 21.

FIGS. 4–10 depict the improved finger insert 10 in accordance with the invention.

Figure 4:
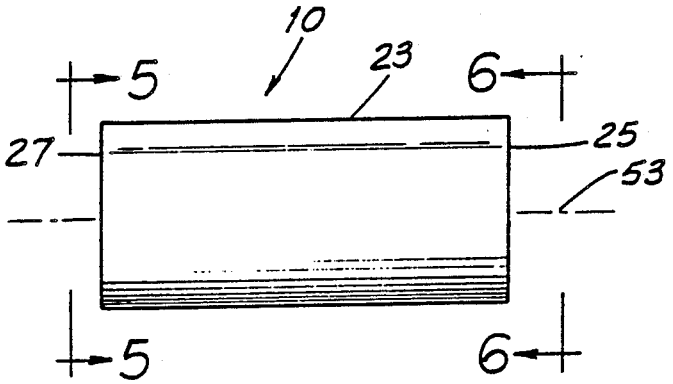
FIG. 4 is a side elevation view of a finger insert according to the invention.

Referring first to FIG. 4, the insert 10 includes a body 23 which has a generally cylindrical exterior shape. The diameter and length of the body 23 are selected to fit within holes of the sizes commonly used in bowling balls. That is, the diameter is selected so that the body 23 fits snugly within the hole. Length is selected so that when the distal end 25 of the insert 10 is "bottomed" in the hole, the proximal end 27 is generally flush with the spherical surface of the ball.

Figure 6:
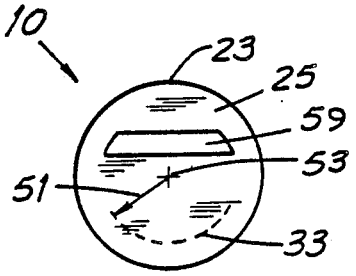
FIG. 6 is an end elevation view of the insert of FIG. 4 taken along the viewing plane 6—6 thereof and with part shown in dotted outline.
Figure 7:
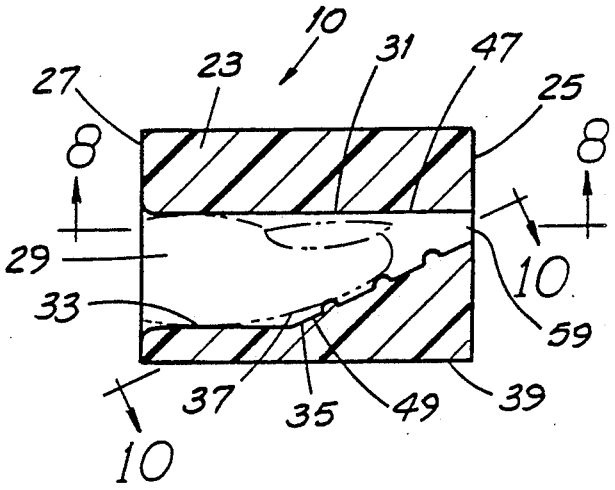
FIG. 7 is a cross sectional side elevation view of the insert of FIG. 4 taken along the viewing plane 7—7 of FIG. 7 with a bowler's finger shown in phantom outline.
Figure 5:
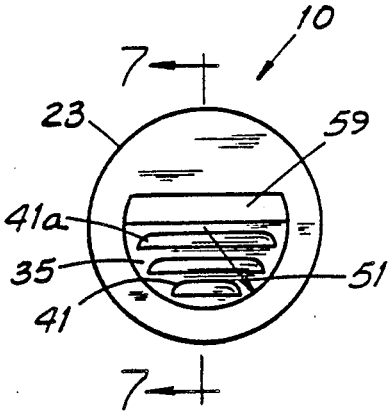
FIG. 5 is an end elevation view of the insert of FIG. 4 taken along the viewing plane 5—5 thereof.

Referring next to FIGS. 5, 6 and 7, an interior cavity 29 is formed in the body 23 and is defined by a generally planar first surface 31 extending along the length thereof. Such cavity 29 is further defined by a curved surface 33 and by a generally planar second surface 35 which is spaced from the first surface 31 and extends partially along the length of the cavity 29. These surfaces 31, 33, 35 are relatively positioned and coact to impart a shape to the cavity 29 which generally resembles that of the distal portion of a human finger. This is shown in FIG. 7 where the finger 37 is shown in phantom outline.

Viewing FIG. 7, it will be appreciated that in cross-section, the cavity 29 is generally wedge-shaped at that portion of the body 23 adjacent the distal end 25. Such wedge shape is derived from the relative positions of the first surface 31 and the second surface 35, the latter being arranged generally angularly with respect to the former. In a highly preferred embodiment, the preferred included angle between the second surface 35 and the lower extremity 39 of the insert 10 is about 30°. Such arrangement generally conforms the shape of the cavity 29 adjacent the distal end 25 to that of the distal end of a finger 37.

An important consideration for a bowler using finger inserts is that the insert facilitate substantially the same depth of insertion of a finger each time the ball is used. This helps provide more consistent control of the ball and, of course, better scores result. Accordingly, the second surface 35 includes at least one projection 41 extending outwardly therefrom to provide a tactile indication of correct insertion depth of a finger within such insert 10. In a highly preferred embodiment, the second surface 35 includes a plurality of such projections 41 embodied as raised ridges 41*a* extending generally laterally across the second surface 35. When an inserted finger contacts such projections 41, no visual inspection or other precautions are necessary to assure that the finger insertion depth is proper.

Yet another important consideration is that the interior cavity 29 of the finger insert 10 be sized so that the lower surface and tip of the finger 37, those finger regions most important for ball control, are urged into contact with the curved surface 33, the second surface 35 and the projections 41 thereon. Accordingly, the first surface 31 of the insert 10 is adapted to receive one or more strips of bowler's tape 43 in that such surface 31 has a width "w" selected to generally correspond to that of the tape 43.

Figure 8:
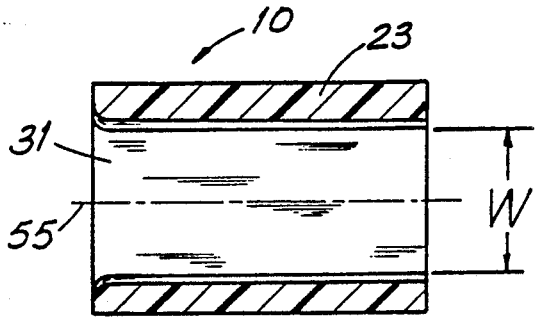
FIG. 8 is a view of the first surface of the insert taken along the viewing plane 8—8 of FIG. 7.
Figure 10:
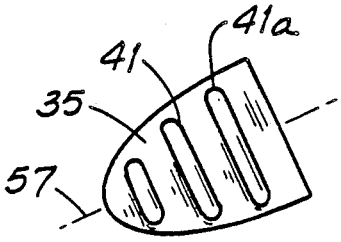
FIG. 10 is a view of the second surface of the insert taken along the viewing plane 10—10 of FIG. 7.
Figure 9:
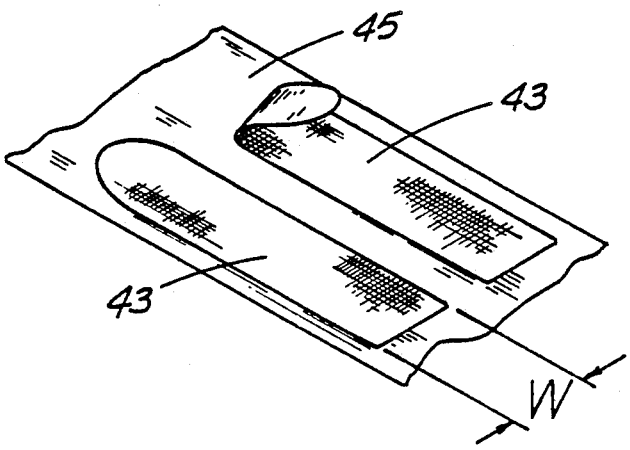
FIG. 9 is a perspective view of strips of commonly-available bowler's tape dispensed from a paper strip, with portions broken away.

This is best appreciated by reference to FIGS. 8 and 9. Bowler's tape 43 is dispensed on paper ribbons 45 with pre-cut pieces of tape 43 adhering thereto. When a bowler wishes to change the size of the interior cavity 29 for better finger fit, one or more strips of tape 43 are inserted through the cavity 29 and pressed to adhere to the first surface 31 (or to a previously-applied strip) along its length. Application of such tape 43 thereby urges the finger 37 toward the second surface 35 and the curved surface 33.

It is to be appreciated that such tape 43 may be used to decrease or increase the size of the interior cavity. For example, fingers usually diminish in size somewhat in very cold weather. A bowler exposed to such weather just prior to a game may wish to add several strips of tape 43 to the insert 10 in laminar fashion. As the fingers warm and swell slightly (as they usually do during progress of play even in warm weather), one or more strips of tape 43 may be removed to retain good fit.

Referring again to FIG. 7, the first surface 31 is positioned at what is termed the top side 47 of the cavity 29, i.e., that which is adjacent the finger nail and top surface of the finger 37 when such finger 37 is inserted. The curved surface 33 and the second surface 35 are positioned at the bottom side 49 of the interior cavity 29, i.e., that side in contact with the lower portion and tip of the finger 37.

The curved surface 33 of the cavity 29 may assume any one of several shapes. However, referring to FIGS. 6, 7, 8 and 10 and in a highly preferred embodiment, the curved surface 33 has a generally uniform radius of curvature 51. Stated another way, such curved surface 33 represents a segment of a cylinder. The cavity 29 has a longitudinal centerline 53 and a preferred curved surface 33 is positioned such that an end of the radius of curvature 51 is coincident with such longitudinal centerline 53.

The first surface 31 and the second surface 35 also have longitudinal centerlines 55 and 57, respectively. The centerline 55 of the first surface 31 is generally parallel to and spaced from the centerline 53 of the cavity 29. The second surface 35 is positioned such that its projected centerline 57 intersects the projected centerline 53 of the cavity 29 and the projected centerline of the first surface 55. Such relative positioning of the surfaces 31, 33 and 35 is in recognition of the general symmetry of the human finger when viewed from the top or the bottom.

Referring next to FIGS. 5, 6 and 7, the body 23 has a distal end 25 which is substantially enclosed and the intersection of the first surface 31, the second surface 35 and the curved surface 33 with this distal end 25 defines an elongate aperture 59 therein. In FIG. 6, the aperture 59 is positioned slightly above the centerline 53 of the cavity 29. However, the position of the aperture 59 will depend upon the nominal size of the interior cavity 29 of the insert 10. Such interior cavities are available in ten standard sizes and the illustrated position of the aperture 59 is that of the smaller size. In larger sizes, the lower edge of the aperture 59 will extend slightly below the centerline 53.

An aperture 59 of some type is required by the American Bowling Congress. Such apertures permit quick visual inspection of the finger hole below the insert to help assure that the bowling ball is devoid of any non-regulation features.

While the principles of this invention have been described in connection with specific embodiments, it should be understood clearly that these descriptions are made only by way of example and are not intended to limit the scope of the invention.

What is claimed is:

1. An improved bowling ball insert including:

a generally cylindrical body;

an interior cavity formed in the body, such cavity being defined by a generally planar first surface extending along the length thereof;

such cavity being further defined by a curved surface and by a generally planar second surface which is spaced from the first surface and extends partially along the length of the cavity;

whereby the cavity has a shape generally resembling that of the distal portion of a human finger.

2. The insert of claim 1 wherein the body has a proximal end and a distal end and wherein the cavity is generally wedge-shaped in cross section at that portion of the body adjacent the distal end.

3. The insert of claim 2 wherein the second surface includes at least one projection extending outwardly therefrom to provide a tactile indication of correct insertion depth of a finger within such insert.

4. The insert of claim 3 wherein the second surface includes a plurality of such projections and wherein such projections are embodied as ridges extending generally laterally across the second surface.

5. The insert of claim 1 adapted to receive a strip of bowler's tape having a width and adhering to the first surface and wherein the width of the first surface generally corresponds to the width of the bowler's tape.

6. The insert of claim 5 wherein the relative positions of the first surface, the second surface and the curved surface are such that when a strip of bowler's tape is applied to the first surface, a finger inserted into the cavity is urged toward the second surface and the curved surface by such tape, thereby permitting the insert to be adapted to fingers of differing sizes.

7. The insert of claim 1 wherein the cavity has a top side and a bottom side and wherein the first surface is positioned generally at the top side and the curved surface and the second surface are positioned generally at the bottom side.

8. The insert of claim 7 wherein the cavity has a longitudinal centerline, wherein the curved surface has a generally uniform radius of curvature with an end of such radius being coincident with such longitudinal centerline, wherein the first surface has a longitudinal centerline which is generally parallel to and spaced from that of the cavity and wherein the second surface has a longitudinal centerline which projects to intersect the projected centerline of the cavity and the projected centerline of the first surface.

9. The insert of claim 1 wherein the body has a distal end which is substantially enclosed and wherein the intersection of the first surface, the second surface and the curved surface with such distal end defines an elongate aperture in such distal end.

* * * * *

UNITED STATES PATENT AND TRADEMARK OFFICE

CERTIFICATE OF CORRECTION

PATENT NO. : 5,002,277

DATED : March 26, 1991

INVENTOR(S) : Phillip G. Ontko

It is certified that error appears in the above-identified patent and that said Letters Patent is hereby corrected as shown below:

On the title page at the Assignee section, "Bob's Business, Inc., Red Wing, Minn." should be changed to --Bobs' Business, Inc., Red Wing, Minn.--.

On the title page, at the Attorney, Agent, or Firm section, "Jansson, Ltd." should be changed to --Law Firm of Peter N. Jansson, Ltd.--.

Signed and Sealed this

Eighth Day of September, 1992

*Attest:*

DOUGLAS B. COMER

*Attesting Officer*

*Acting Commissioner of Patents and Trademarks*